US010570545B2

(12) United States Patent
Li et al.

(10) Patent No.: US 10,570,545 B2
(45) Date of Patent: Feb. 25, 2020

(54) CONTROL METHOD OF A DOUBLE-DRUM WASHING MACHINE

(71) Applicant: QINGDAO HAIER DRUM WASHING MACHINE CO., LTD., Qingdao, Shandong (CN)

(72) Inventors: Wenwei Li, Shandong (CN); Jinkai Wang, Shandong (CN); Jun Wu, Shandong (CN); Yuanyuan Chang, Shandong (CN)

(73) Assignee: QINGDAO HAIER DRUM WASHING MACHINE CO., LTD., Qingdao, Shandong (CN)

( * ) Notice: Subject to any disclaimer, the term of this patent is extended or adjusted under 35 U.S.C. 154(b) by 295 days.

(21) Appl. No.: 15/534,980

(22) PCT Filed: Aug. 31, 2015

(86) PCT No.: PCT/CN2015/088594

§ 371 (c)(1),
(2) Date: Jun. 9, 2017

(87) PCT Pub. No.: WO2016/090972

PCT Pub. Date: Jun. 16, 2016

(65) Prior Publication Data

US 2017/0335500 A1 Nov. 23, 2017

(30) Foreign Application Priority Data

Dec. 12, 2014 (CN) ..... 2014 1 0772449

(51) Int. Cl.
*D06F 33/02* (2006.01)
*D06F 29/00* (2006.01)
(Continued)

(52) U.S. Cl.
CPC ..... *D06F 33/02* (2013.01); *D06F 29/005* (2013.01); *D06F 29/02* (2013.01); *D06F 37/04* (2013.01);
(Continued)

(58) Field of Classification Search
None
See application file for complete search history.

(56) References Cited

U.S. PATENT DOCUMENTS 3,575,020 A * 4/1971 Hubbard ..... D06F 13/00 68/12.19
4,637,230 A * 1/1987 Roberts ..... D06F 29/00 68/18 FA
(Continued)

FOREIGN PATENT DOCUMENTS

CN 1727550 A 2/2006
CN 101113557 A 1/2008
(Continued)

OTHER PUBLICATIONS

International Search Report (PCT/ISA/210) dated Dec. 10, 2015, by the Chinese Patent Office as the International Searching Authority for International Application No. PCT/CN2015/088594.
(Continued)

*Primary Examiner* — Cristi J Tate-Sims
(74) *Attorney, Agent, or Firm* — Buchanan Ingersoll & Rooney PC

(57) ABSTRACT

A double-drum washing machine has a first washing drum and a second washing drum. A control method comprises water intake and drainage control and high-power process control, wherein the water intake and drainage control comprises water intake control and water drainage control; the first washing drum judges whether to reuse drained water of the second washing drum before executing a water intake process and judges whether to enable the drained water to be drained into the second washing drum and reuse the water or not before executing a water drainage process; and the high-power process control is used for controlling any one of a heating process, a dewatering process and a drying process of the first washing drum and any one of a heating
(Continued)

process, a dewatering process and a drying process of the second washing drum not to be executed at the same time.

10 Claims, 7 Drawing Sheets

(51) Int. Cl.
*D06F 29/02* (2006.01)
*D06F 37/04* (2006.01)

(52) U.S. Cl.
CPC .... *D06F 2202/04* (2013.01); *D06F 2202/085* (2013.01); *D06F 2204/04* (2013.01); *D06F 2204/084* (2013.01); *D06F 2204/086* (2013.01); *D06F 2220/00* (2013.01)

(56) References Cited

U.S. PATENT DOCUMENTS

| | | | | |
|---|---|---|---|---|
| 8,015,646 | B2 | 9/2011 | Lee et al. | |
| 2008/0022465 | A1 | 1/2008 | Jun et al. | |
| 2008/0155760 | A1* | 7/2008 | Hoppe | D06F 39/02 8/159 |
| 2009/0133197 | A1 | 5/2009 | Lee et al. | |
| 2010/0138055 | A1 | 6/2010 | Jun et al. | |
| 2015/0299927 | A1* | 10/2015 | Kim | D06F 31/00 68/27 |
| 2016/0032515 | A1* | 2/2016 | Lee | D06F 13/00 68/27 |

FOREIGN PATENT DOCUMENTS

| | | | |
|---|---|---|---|
| CN | 102203337 | A | 9/2011 |
| CN | 202193989 | U | 4/2012 |
| JP | 56-27300 | | 3/1981 |
| KR | 2001-0065084 | A | 7/2001 |

OTHER PUBLICATIONS

Written Opinion (PCT/ISA/237) dated Dec. 10, 2015, by the Chinese Patent Office as the International Searching Authority for International Application No. PCT/CN2015/088594.

* cited by examiner

CONTROL METHOD OF A DOUBLE-DRUM WASHING MACHINE

TECHNICAL FIELD

The present disclosure relates to the technical field of control of washing machines, in particular to a control method of a double-drum washing machine.

BACKGROUND

At present, a drum washing machine which is on sale in the market is only provided with one washing drum. With the improvement of people's life quality, people's health awareness is also gradually increased, and particularly in the aspect of family laundry, more and more people wash clothes separately. For example, underwear and outerwear are separately washed; infant clothes and adult clothes are separately washed; clothes with different colours are separately washed; or a small number of clothes are washed in time. If the aforementioned washing mode is realized by adopting a conventional washing machine, not only can a great deal of energy and water be wasted, but also it is difficult to meet the sanitary requirements of users. If two or more washing machines are purchased to meet needs, not only is the cost increased, but also the trouble that a large space is occupied can be brought.

Therefore, a double-drum washing machine is adopted, so that the requirements can be met, the cost can be sufficiently controlled and the problem that energy, water and space are wasted can be solved. Reasonable double-drums are designed to be arranged up and down, so that saving of the space is facilitated, but subsequently, the control problem of the use power of the complete machine is brought, and particularly, the use stability and the service life of the machine are seriously affected by an overload condition caused when heating, drying and high-speed dewatering are performed at the same time.

The patent application No CN201120326451.6 discloses a washing machine comprising at least two washing drums. The washing drums are connected by a communicating pipe, and a control valve and a water pump are arranged on the communicating pipe. The mutual utilization of washing water in the drums on two sides is realized through the control valve and the water pump. But a control method for mutual utilization is undisclosed. In practice, the water in the two drums can be mutually utilized sometimes and cannot be mutually utilized sometimes, and if reuse can only be selected artificially, someone in a family have to observe and operate the washing machine constantly, so that the restriction of operation inconvenience exists, and the defect of judgement inaccuracy exists.

In the patent application No CN200880124154.4, a method relates to a control logic for heating in the use of the double-drum washing machine: the two drums perform heating alternately or in order, and the priorities of the two drums are determined by judging the remaining washing time when commands are received at the same time. According to the control method disclosed by the patent, a single ordered heating control method or a single alternate control method is disclosed, and a manner that the single ordered heating control method and the single alternate control method are combined in an actual use process can exist, but is undisclosed in the patent document. And in addition, it seems to be complex in the control of the double drums in the patent document, and it is not comprehensive enough for power control.

Therefore, how to realize overall control on a double-drum or multi-drum washing machine so as to solve conventional technical problems becomes a technical problem to be urgently solved.

SUMMARY

In order to solve the problems, the present disclosure provides a control method of a double-drum washing machine, and the control method particularly adopts the technical scheme as follows:

a control method of a double-drum washing machine, the washing machine at least comprises a first washing drum and a second washing drum. The control method comprises a water intake and drainage control and a high-power process control. The water intake and drainage control comprises a water intake control and a water drainage control. The first washing drum judges whether to reuse drained water of the second washing drum or not before executing a water intake process. The first washing drum judges whether to enable the drained water to be drained into the second washing drum and reuse the water or not before executing a water drainage process. The high-power process control is used for controlling any one of a heating process, a dewatering process and a drying process of the first washing drum and any one of a heating process, a dewatering process and a drying process of the second washing drum not to be executed at the same time.

Further, the water intake control of the water intake and drainage control comprises: comparing time $T_{22}$ that the second washing drum waits for execution of the water drainage process with time $T_{21}$ that the first washing drum waits for execution of the next water intake process before the first washing drum executes the water intake process. If $T_{22} \geq T_{21}$, enabling pure water to directly enter the first washing drum, and if $T_{22} < T_{21}$, enabling the first washing drum to wait until the second washing drum performs water drainage.

Further, judging whether water in the second washing drum can be reused or not before comparing the time $T_{22}$ that the second washing drum waits for an execution of the water drainage process with the time $T_{21}$ that the first washing drum waits for execution of the next water intake process. If not, enabling the pure water to directly enter the first washing drum, and if yes, comparing the time $T_{22}$ that the second washing drum waits for execution of the water drainage process with the time $T_{21}$ that the first washing drum waits for execution of the next water intake process.

Or judging whether water in the second washing drum can be reused or not when the first washing drum waits until the second washing drum performs water drainage. If not, enabling the pure water to directly enter the first washing drum, and if yes, enabling the water in the second washing drum to be drained into the first washing drum, and reusing the water.

Further, the water drainage control of the water intake and drainage control comprises: comparing time $T_{12}$ that the second washing drum waits for execution of the water intake process with the time $T_{11}$ that the first washing drum waits for execution of the next water drainage process before the first washing drum executes the water drainage process. If $T_{12} < T_{11}$, enabling the first washing drum to wait until the second washing drum performs water intake, and if $T_{12} \geq T_{11}$, enabling water in the first washing drum to be directly drained.

Further, judging whether the water in the first washing drum can be reused or not before comparing the time $T_{12}$ that the second washing drum waits for execution of the water intake process with the time $T_{11}$ that the first washing drum waits for execution of the next water drainage process. If not, enabling the water in the first washing drum to be directly drained, and if yes, comparing the time $T_{12}$ that the second washing drum waits for execution of the water intake process with the time $T_{11}$ that the first washing drum waits for execution of the next water drainage process.

Or judging whether the water in the first washing drum can be reused or not when the first washing drum waits until the second washing drum performs water intake. If not, enabling the water in the first washing drum to be directly drained, and if yes, enabling the water in the first washing drum to be drained into the second washing drum, and reusing the water.

Further, the high-power process control comprises a heating process control, a dewatering process control and a drying process control, and controls the second washing drum not to execute any one of the heating process, the dewatering process and the drying process at the same time when the first washing drum executes the heating process, and controls the second washing drum not to execute any one of the dewatering process, the drying process and the heating process at the same time when the first washing drum executes the dewatering process, and controls the second washing drum not to execute any one of the drying process, the heating process and the dewatering process at the same time when the first washing drum executes the drying process.

Further, the heating process control of the high-power process control comprises:

step S21: enabling the first washing drum to perform heating;

step S22: judging whether the second washing drum performs heating or not;

step S23: if yes, judging whether the remaining heating time of the second washing drum is greater than $T_0$ or not;

step S24: if yes, executing an alternate heating program that the first washing drum and the second washing drum perform heating alternately, if not, executing an ordered heating program that the second washing drum performs heating firstly, and then the first washing drum performs heating, wherein $T_0$ is a time value set by a system and used for judging whether the second washing drum is about to finish heating or not.

Further, if the judgement result in the step S22 is no, the following steps are performed:

judging whether any one of the dewatering process and the drying process is executed by the second washing drum or not, if yes, enabling the first washing drum to start to perform heating after the second washing drum finishes the dewatering process or the drying process, if not, enabling the first washing drum to directly start to perform heating.

Further, before performing the step S21 in the heating process control of the high-power process control, the following judgements are performed:

judging whether the heating time required by the first washing drum is overlong or not, if yes, enabling the second washing drum to preferentially execute the heating, or dewatering, or drying process, if not, performing the step S21.

Further, the step of judging whether the heating time required by the first washing drum is overlong or not comprises the following judgement conditions:

a) whether a set heating temperature of the first washing drum is higher than a normal set temperature or not;

b) whether a water intake quantity of the first washing drum is greater than common water intake quantity or not; and c) whether a difference of the set heating temperature value and a real-time measurement value of the first washing drum is greater than a difference of a set heating temperature value and a real-time measurement value of the second washing drum or not.

If all the judgement results in a), b) and c) are no, determining that the heating time required by the first washing drum is not overlong.

If any one of the judgement results in a), b) and c) is yes, determining that the heating time required by the first washing drum is overlong.

By using the control method provided by the present disclosure, the overall control on the double-drum washing machine is realized, the water intake and drainage control is used for enabling washing water in the first washing drum/the second washing drum to be drained into the second washing drum/the first washing drum and reusing the water, so that the recycle of the available washing water is realized, and more energy-saving and environment-protecting effects are achieved. And the high-power process control is used for controlling any one of the heating, dewatering and drying processes of the first washing drum and any one of the heating, dewatering and drying processes of the second washing drum not to be executed at the same time to realize the control on the overall power of the washing machine. It prevents the power of the washing machine from being over high and guarantees the stability and the service life of the washing machine.

Therefore, the control method provided by the present disclosure is safer and more reliable, is energy-saving and environment-friendly, is capable of realizing the reuse of available water and guaranteeing the stability and the service life of the double-drum washing machine, and can be conveniently popularized and applied on the market.

Figure 1:
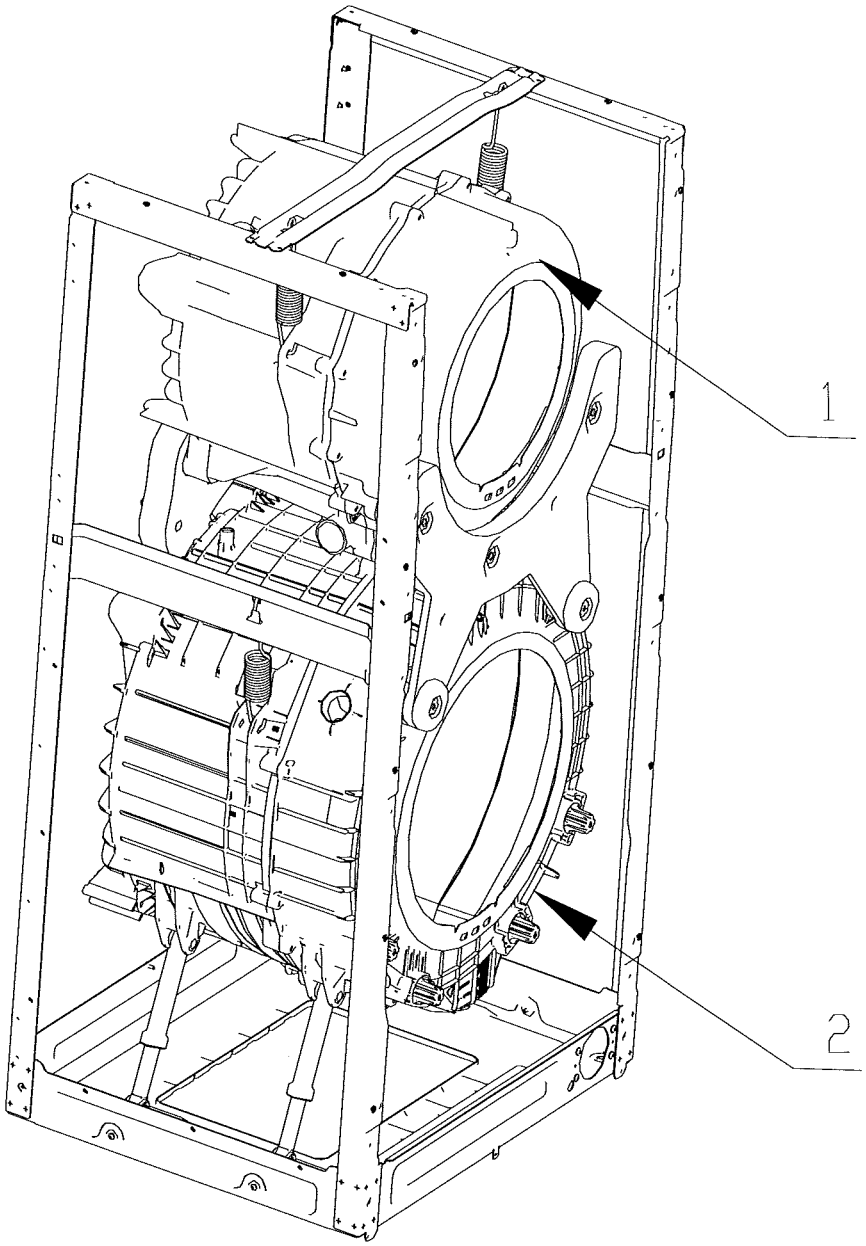
FIG. 1 is a schematic diagram of a double-drum washing machine provided by the present disclosure.

Reference signs in the drawings: 1, first washing drum; 2, second washing drum.

DETAILED DESCRIPTION

A control method of a double-drum washing machine, provided by the present disclosure, is described in detail below in conjunction with the drawings:

A control method of a double-drum washing machine, the washing machine at least comprises a first washing drum and a second washing drum. The control method comprises a water intake and drainage control and a high-power process control, wherein the water intake and drainage control comprises a water intake control and a water drainage control. The first washing drum judges whether to reuse drained water of the second washing drum or not before executing a water intake process. The first washing drum judges whether to enable the drained water to be drained into the second washing drum and reuse the water or not before executing a water drainage process. And the high-power process control is used for controlling any one of a heating process, a dewatering process and a drying process of the first washing drum and any one of a heating process, a dewatering process and a drying process of the second washing drum not to be executed at the same time.

By using the control method provided by the present disclosure, the overall control on the double-drum washing machine is realized, the water intake and drainage control realizes the purpose of enabling washing water in the first washing drum/the second washing drum to be drained into the second washing drum/the first washing drum and reusing the water, so that the available washing water is reused, and more energy-saving and environment-protecting effects are achieved. The high-power process control is used for controlling any two of the heating, dewatering and drying processes of the first washing drum and the second washing drum not to be executed at the same time to realize the control on the overall power of the washing machine. It prevents the power of the washing machine from being over high and guarantees the stability and the service life of the washing machine.

Therefore, the control method provided by the present disclosure is safer and more reliable, is energy-saving and environment-friendly, is capable of realizing the reuse of available water and guaranteeing the stability and the service life of the double-drum washing machine, and can be conveniently popularized and applied on the market.

Embodiment 1

As shown in FIG. 1, a double-drum washing machine is provided with a first washing drum 1 and a second washing drum 2 which are capable of independently performing a clothes washing step. Any one of the first washing drum 1 and the second washing drum 2 can independently execute a water intake process, a washing process, a water drainage process, a rinsing process and a dewatering process on clothes sequentially, so that the purpose of washing the clothes is achieved. Preferably, each of the first washing drum and the second washing drum can also be additionally provided with a drying device for executing a drying process after executing the dewatering process, so that the purpose of drying the clothes in the first washing drum and/or the second washing drum is achieved. Preferably, a first heating device for heating washing water in the first washing drum is arranged in the first washing drum, and a second heating device for heating washing water in the second washing drum is arranged in the second washing drum. Therefore, the washing water in the corresponding washing drum is heated in the process of executing the washing process to control water temperature during clothes washing, so that the washing effect is improved.

According to the control method disclosed by the present disclosure, the first washing drum communicates with the second washing drum, water in the first washing drum can be drained into the second washing drum to be reused after a certain condition is met. Water in the second washing drum can be drained into the first washing drum and can be reused after a certain condition is met. And the water is directly drained by a water drainage pipe if a reuse condition is not met, so that the utilization ratio of the water is increased, and the waste of the water source is avoided. Besides, a control process is additionally set to ensure that the water can be reused only when the water is relatively clean, so that the washing effect is guaranteed.

Embodiment 2

Figure 2:
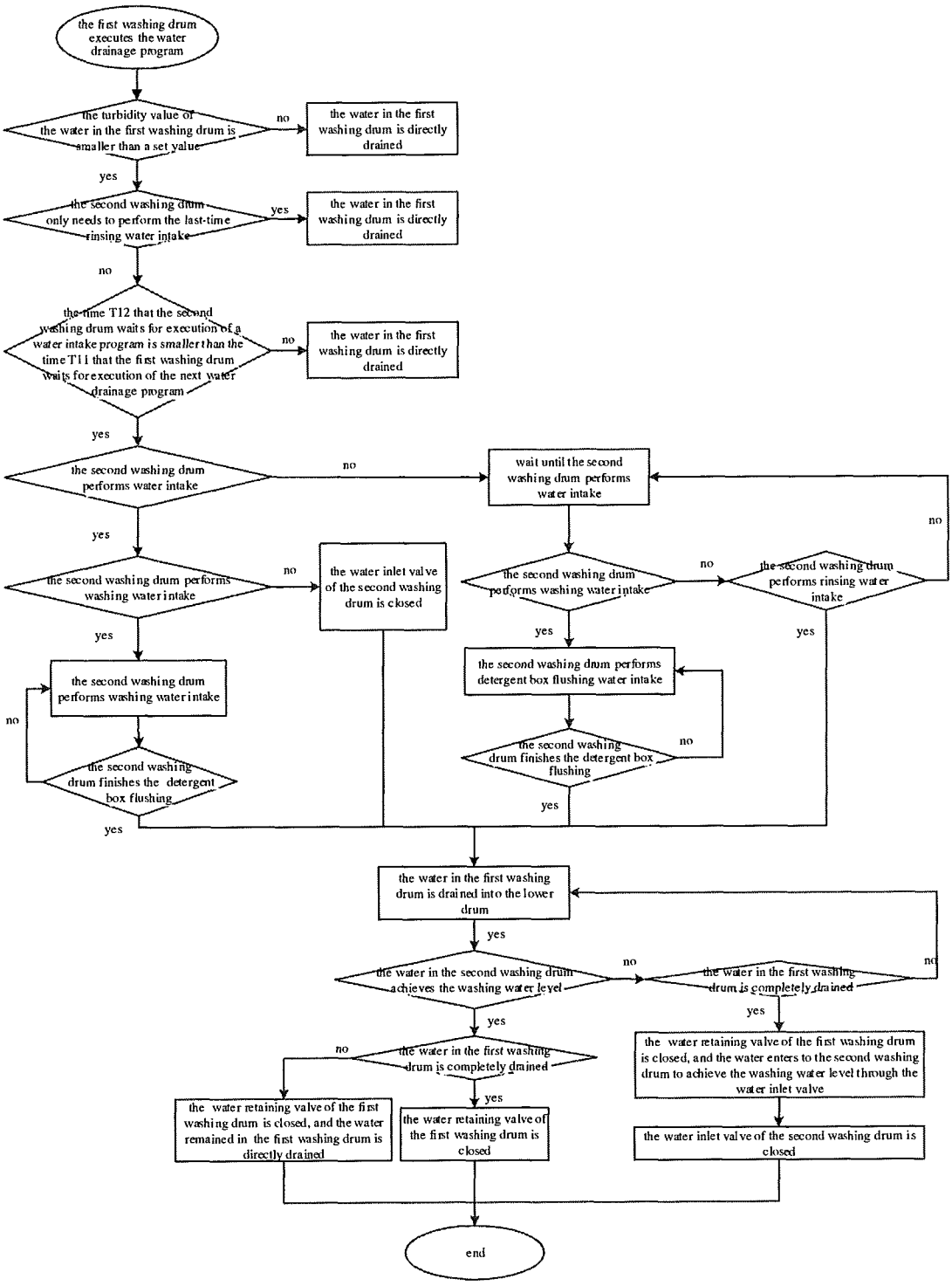
FIG. 2 is a flow chart of a control method for water intake and drainage control of the present disclosure.

As shown in FIG. 2, the water drainage control of the water intake and drainage control in the embodiment is used for judging whether to reuse the water or not by taking water drainage waiting time as a judgement standard, and judging whether to wait for drainage of the water into the other drum and reuse the water or not when the water drainage process is performed according to the water drainage waiting time. So that simple judgement and control logics are realized, and the control stability is higher in an actual washing process. Besides, the water is sufficiently reused, the practical value is high, and the water drainage control can be more effectively popularized and applied.

When the first washing drum and the second washing drum are in a working state at the same time, a control method for reuse of water is as follows:

Disclosed is a control method for reuse of water of a multi-drum washing machine, the multi-drum washing machine at least comprises a first washing drum and a second washing drum. When the first washing drum and the second washing drum are in a working state at the same time, and before the first washing drum executes a water drainage process, comparing time $T_{12}$ that the second washing drum waits for execution of a water intake process with time $T_{11}$ that the first washing drum waits for execution of the next water drainage process. If $T_{12}<T_{11}$, enabling the first washing drum to wait until the second washing drum performs water intake, and if $T_{12}\geq T_{11}$, enabling the water in the first washing drum to be directly drained.

Judging whether the water in the first washing drum can be reused or not before comparing the time $T_{12}$ that the second washing drum waits for execution of the water intake process with the time $T_{11}$ that the first washing drum waits for execution of the next water drainage process. If not, enabling the water in the first washing drum to be directly drained, and if yes, comparing the time $T_{12}$ that the second washing drum waits for execution of the water intake process with the time $T_{11}$ that the first washing drum waits for execution of the next water drainage process.

Or judging whether the water in the first washing drum can be reused or not when the first washing drum waits until the second washing drum performs water intake. If not, enabling the water in the first washing drum to be directly drained, and if yes, enabling the water in the first washing drum to be drained into the second washing drum, and reusing the water.

The control method specifically comprises: step 1: judging whether the water in the first washing drum can be reused or not when the first washing drum executes the water drainage process, if yes, performing step 2, if not, enabling the water in the first washing drum to be directly drained;

step 2: comparing the time $T_{12}$ that the second washing drum waits for execution of the water intake process with the time $T_{11}$ that the first washing drum waits for execution of the next water drainage process. If $T_{12}<T_{11}$, enabling the first washing drum to wait until the second washing drum performs water intake, enabling the water in the first washing drum to be drained into the second washing drum, and reusing the water. If $T_{12}\geq T_{11}$, enabling the water in the first washing drum to be directly drained. A process of judging whether to wait or not is additionally added, so that the probability that the water in the first washing drum is reused is increased to a great extent, and more water can be reused.

In the step 1, if the second washing drum is performing water intake when the first washing drum executes the water drainage process, the time $T_{12}$ that the second washing drum waits for execution of the water intake process is 0, the second washing drum does not need waiting, and the water in the first washing drum is drained into the second washing drum to be reused. Whether the second washing drum is executing the water intake process or not at the moment can also be judged firstly before the time $T_{12}$ that the second washing drum waits for execution of the water intake process is compared with the time $T_{11}$ that the first washing drum waits for execution of the next water drainage process. And when the second washing drum does not execute the water intake process, the time $T_{12}$ that the second washing drum waits for execution of the water intake process is compared with the time $T_{11}$ that the first washing drum waits for execution of the next water drainage process.

In the step 2, allowable waiting time $T_1$ is set, $T_1<T_{11}$. If $T_{12}<T_1$, the first washing drum waits until the second washing drum performs water intake, the water in the first washing drum is drained into the second washing drum to be reused. And if $T_{12}\geq T_1$, the water in the first washing drum is directly drained. In the step, the phenomenon that the first washing drum waits for overlong time can be avoided, the water is reasonably reused on the premise that the washing time of the first washing drum is guaranteed. The phenomenon that the overlong time of the first washing drum is wasted because only reuse of water is taken into account can be avoided. The water in the first washing drum is not reused if the washing machine judges that the waiting time is overlong and exceeds the set allowable waiting time. The judgement enables the reuse of water to become more reasonable, and the relationship between the waiting time and the reuse of water is coordinated to the maximum extent.

In the step 1, a turbidity value or a foam concentration value of the water in the first washing drum is detected. If the turbidity value or the foam concentration value is smaller than a set value, the water in the first washing drum can be reused, or else, the water in the first washing drum cannot be reused and is directly drained. The water can be reused only when the turbidity value or the foam concentration value of the water is within a set range.

In the step 1, when the first washing drum executes the water drainage process, whether the process which is executed or to be executed by the second washing drum is a last-time rinsing water intake or not is judged. If yes, the water in the first washing drum is directly drained, if not, whether the water in the first washing drum can be reused or not is further judged. Water entering the second washing drum for last-time rinsing water intake is guaranteed to be pure water, so that the effect achieved after clothes washing is finished is guaranteed.

In the step 2, whether the second washing drum is executing a washing water intake process or not is judged before the water in the first washing drum is drained into the second washing drum. If yes, the second washing drum performs water intake for flushing detergent box firstly, and then, the water in the first washing drum is drained into the second washing drum after the second washing drum finishes water intake for flushing the detergent box. If not, the water in the first washing drum is directly drained into the second washing drum.

In the step 2, a height of a water level inside the second washing drum is detected when the water in the first washing drum is drained into the second washing drum. If some water exists in the first washing drum when the water level inside the second washing drum reaches a set water level value, residual water in the first washing drum is directly drained. And if the water level inside the second washing drum does not reach the set water level value after all the water in the first washing drum is drained into the second washing drum, pure water is enabled to enter the second washing drum through an external water inlet.

Whether the second washing drum executes the dewatering process or not is judged when the water in the first washing drum is directly drained. If yes, the first washing drum waits until the second washing drum finishes dewatering, and then performs water drainage, if not, time that the second washing drum waits for performing of dewatering is determined as $T_{32}$, time that the second washing drum performs dewatering is determined as $T_{33}$, an allowable waiting time $T_3$ is set. If $T_{32}+T_{33}<T_3$, the first washing drum performs water waits until the second washing drum finishes dewatering, then drainage, or else, the water in the first washing drum is directly drained.

Whether the water in the first washing drum can be reused or not can be judged by determining a washing state and washing times. In the step 1, the water in the first washing drum cannot be reused, if the first washing drum is in the washing state during water drainage and the second washing drum is in a rinsing state during water intake, or if the first washing drum is in the washing state during water drainage, the second washing drum is in the washing state during water intake, and the washing times of the first washing drum are less than those of the second washing drum, or if the first washing drum is in the rinsing state during water drainage, the second washing drum is in the rinsing state during water intake, the rinsing times of the first washing drum are less than those of the second washing drum.

Whether the water in the second washing drum can be reused or not is judged when the second washing drum executes the water drainage process. If yes, the time that the first washing drum waits for execution of the water intake process is compared with the time that the second washing drum waits for execution of the next water drainage process, and, whether the second washing drum waits until the first washing drum executes the water intake process or not is judged.

A water outlet of the first washing drum communicates with a water inlet of the second washing drum so that the water in the first washing drum can be drained into the second washing drum to be reused. The water outlet of the first washing drum is provided with a water retaining valve, so that the water in the first washing drum can enter the second washing drum through the water retaining valve. The second washing drum is provided with a water inlet valve, so that external pure water can enter the second washing drum through the water inlet valve, and the control method is as follows:

1), enabling the first washing drum to execute the water drainage process;

2), judging whether the water in the first washing drum can be reused or not, if yes, performing step 3), if not, performing step 6);

3), determining the time that the first washing drum waits for execution of the next water drainage process as $T_{11}$, determining the time that the second washing drum waits for execution of the water intake process as $T_{12}$, if $T_{12}<T_{11}$, performing step 4), and if $T_{12}\geq T_{11}$, performing step 6);

4), enabling the first washing drum to wait until the second washing drum performs water intake, and performing step 5);

5), enabling the water in the first washing drum to be drained into the second washing drum;

6), enabling the water in the first washing drum to be directly drained.

The control method can also be additionally provided with a process of judging whether the second washing drum performs water intake or not at present before comparing the time that the first washing drum waits for execution of the next water drainage process with the time that the second washing drum waits for execution of the water intake process, and the control method is as follows:

1), enabling the first washing drum to execute the water drainage process;

2), judging whether the water in the first washing drum can be reused or not, if yes, performing step 3), if not, performing step 7);

3), judging whether the second washing drum executes the water intake process or not, if not, performing step 4), and if yes, performing step 6);

4) determining the time that the first washing drum waits for execution of the next water drainage process as $T_{11}$, determining the time that the second washing drum waits for execution of the water intake process as $T_{12}$, if $T_{12}<T_{11}$, performing step 5), and if $T_{12}\geq T_{11}$, performing step 7);

5), enabling the first washing drum to wait until the second washing drum performs water intake, and performing step 6);

6), enabling the water in the first washing drum to be drained into the second washing drum;

7), enabling the water in the first washing drum to be directly drained.

The control method can also comprise a process of judging whether the first washing drum has enough time to wait until the second washing drum performs water intake or not, and the control method is as follows:

1), enabling the first washing drum to execute the water drainage process;

2), judging whether the water in the first washing drum can be reused or not, if yes, performing step 3), or else, performing step 8);

3), judging whether the second washing drum executes the water intake process or not, if not, performing step 4), and if yes, performing step 7);

4), determining the time that the first washing drum waits for execution of the next water drainage process as $T_{11}$, determining the time that the second washing drum waits for execution of the water intake process as $T_{12}$, if $T_{12}<T_{11}$, performing step 5), and if $T_{12}\geq T_{11}$, performing step 8);

5), setting allowable waiting time $T_1$, if $T_{12}<T_1$, performing step 6), and if $T_{12}\geq T_1$, performing step 8);

6), enabling the first washing drum to wait until the second washing drum performs water intake, and performing step 7);

7), enabling the water in the first washing drum to be drained into the second washing drum; and 8), enabling the water in the first washing drum to be directly drained.

If the water in the first washing drum is very dirty and the water cannot be reused, or the second washing drum performs the last-time rinsing water intake and the water cannot be reused, the control method is as follows:

1), enabling the first washing drum to execute the water drainage process;

2), detecting the turbidity value or the foam concentration value of the water in the first washing drum, and judging whether the turbidity value or the foam concentration value is smaller than a set value, if yes, performing step 3), and if not, performing step 9);

3), judging whether the second washing drum can only perform the last-time rinsing water intake or not, if not, performing step 4), and if yes, performing step 9);

4), judging whether the second washing drum executes the water intake process or not, if not, performing step 5), and if yes, performing step 8);

5), determining the time that the first washing drum waits for execution of the next water drainage process as $T_{11}$, determining the time that the second washing drum waits for execution of the water intake process as $T_{12}$, if $T_{12}<T_{11}$, performing step 6), and if $T_{12}\geq T_{11}$, performing step 9);

6), setting allowable waiting time $T_1$, if $T_{12}<T_1$, performing step 7), and if $T_{12}\geq T_1$, performing step 9);

7), enabling the first washing drum to wait until the second washing drum performs water intake, and performing step 8);

8), enabling the water in the first washing drum to be drained into the second washing drum; and 9), enabling the water in the first washing drum to be directly drained.

If the second washing drum performs washing water intake when the water in the first washing drum is drained into the second washing drum, the detergent box needs to be flushed, water level detection is also needed, and the control method is as follows:

1), enabling the first washing drum to execute the water drainage process;

2), detecting the turbidity value or the foam concentration value of the water in the first washing drum, and judging whether the turbidity value or the foam concentration value is smaller than a set value, if yes, performing step 3), and if not, performing step 12);

3), judging whether the second washing drum can only perform the last-time rinsing water intake or not, if not, performing step 4), and if yes, performing step 12);

4), judging whether the second washing drum executes the water intake process or not, if not, performing step 5), and if yes, performing step 10);

5), determining the time that the first washing drum waits for execution of the next water drainage process as $T_{11}$, determining the time that the second washing drum waits for execution of the water intake process as $T_{12}$, if $T_{12}<T_{11}$, performing step 6), and if $T_{12}\geq T_{11}$, performing step 12);

6), setting allowable waiting time T1, if $T_{12}$ is smaller than T1, performing step 7), and if $T_{12}\geq T_1$, performing step 12);

7), judging whether the second washing drum executes the washing water intake process or not, if yes, performing step 8), and if not, performing step 10);

8), enabling the second washing drum to firstly perform water intake for flushing detergent box, and after the second washing drum finishes water intake for flushing the detergent box, performing step 9);

9), enabling the first washing drum to wait until the second washing drum performs water intake, and performing step 10);

10), enabling the water in the first washing drum to be drained into the second washing drum;

11), detecting the height of the water level inside the second washing drum, if water exists in the first washing drum when the water level inside the second washing drum reaches the set water level value, enabling the residual water to be drained; and if the water level inside the second washing drum does not reach the set water level value after the water in the first washing drum is completely drained into the second washing drum, enabling the pure water to enter the second washing drum;

12), enabling the water in the first washing drum to be directly drained.

In the embodiment, the first washing drum and the second washing drum are numbered only aiming at convenient illustration, and numbers do not illustrate an ordinal relation. The water in the second washing drum can also be reused, a water outlet of the second washing drum communicates with a water inlet of the first washing drum, so that the water in the second washing drum can be drained into the first washing drum to be reused. The water outlet of the second washing drum is provided with a water retaining valve, so that the water in the second washing drum can enter the first washing drum through the water retaining valve; the first washing drum is provided with a water inlet valve, so that the external pure water can enter the first washing drum through the water inlet valve. When one of the washing drums performs water drainage, whether the water in the other washing drum is drained into the washing drum to be reused or not is judged, and the other washing drum takes no account of reuse of the water in the washing drum when performing water drainage, so that dead cycle caused by a phenomenon that the two drums both wait is avoided.

The specific control method is the same as the above and is only different from the above in that the serial number of the first washing drum and the second washing drum are exchanged, and the specific control method is not repeated again herein.

Embodiment 3

Figure 3:
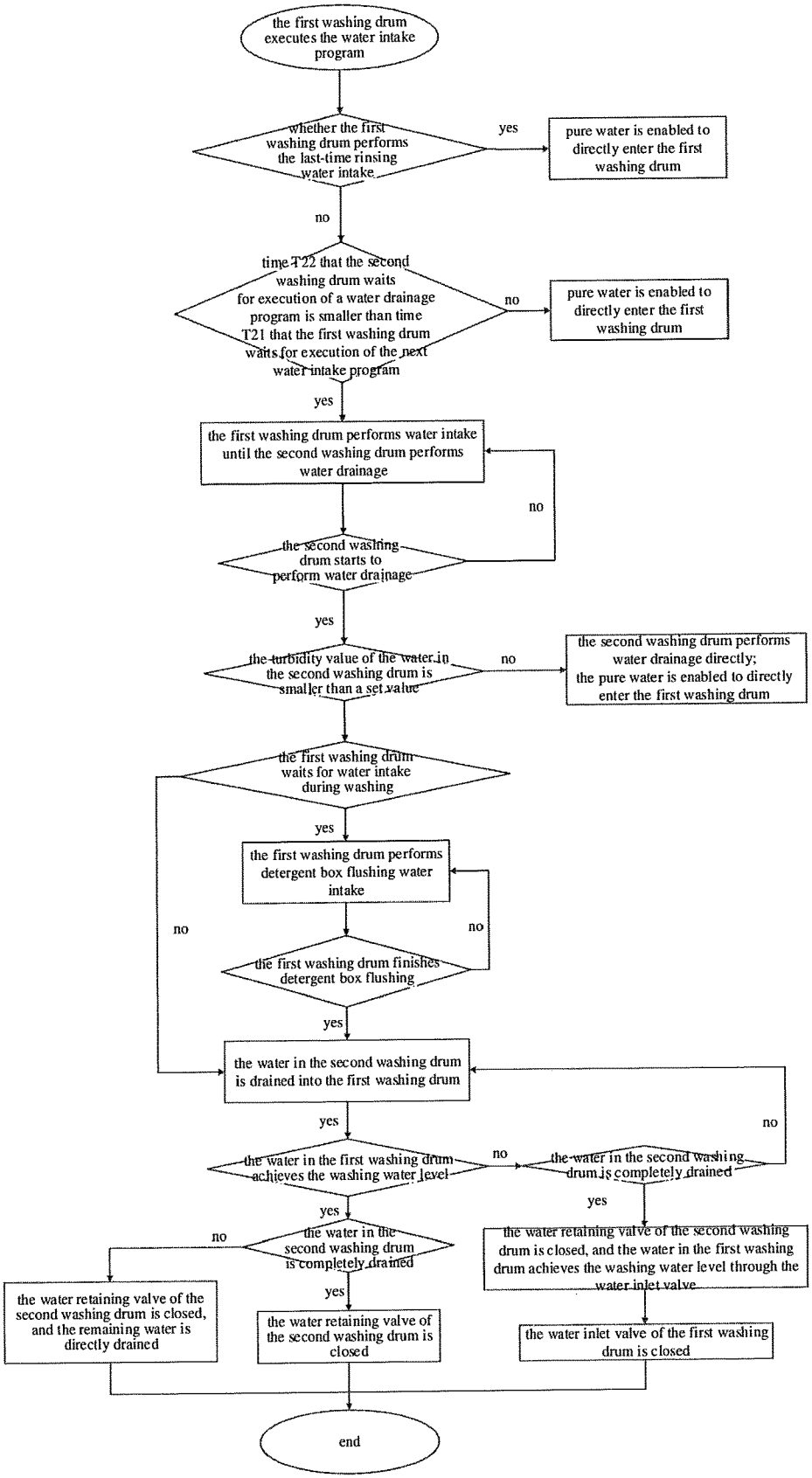
FIG. 3 is a flow chart of a control method in the other embodiment for water intake and drainage control of the present disclosure.

As shown in FIG. 3, the water intake control of the water intake and drainage control in the embodiment is used for judging whether to reuse the water or not by taking water intake waiting time as a judgement standard, and judging whether to reuse the water drained from the other drum when the current drum executing the water intake process according to the water intake waiting time. So that simple judgement and control logics are realized, and the control stability is higher in an actual washing process. Besides, the water is sufficiently reused, the practical value is high, and the water drainage control can be more effectively popularized and applied.

When the first washing drum and the second washing drum are in a working state at the same time, a control method for reuse of water is as follows:

Disclosed is a control method for reuse of water of a multi-drum washing machine, the multi-drum washing machine at least comprises a first washing drum and a second washing drum. When the first washing drum and the second washing drum are in a working state at the same time, the control method for reuse of water is as follows: before the first washing drum executes a water intake process, comparing time $T_{22}$ that the second washing drum waits for execution of a water drainage process with time $T_{21}$ that the first washing drum waits for execution of the next water intake process. If $T_{22} \geq T_{21}$, enabling pure water to directly enter the first washing drum, and if $T_{22} < T_{21}$, enabling the first washing drum to wait until the second washing drum performs water drainage.

Judging whether the water in the second washing drum can be reused or not before comparing the time $T_{22}$ that the second washing drum waits for execution of the water drainage process with the time $T_{21}$ that the first washing drum waits for execution of the next water intake process. If not, enabling the pure water to directly enter the first washing drum, and if yes, comparing the time $T_{22}$ that the second washing drum waits for execution of the water drainage process with the time $T_{21}$ that the first washing drum waits for execution of the next water intake process. Or judging whether the water in the second washing drum can be reused or not when the first washing drum waits until the second washing drum performs water drainage, if not, enabling the pure water to directly enter the first washing drum, and if yes, enabling the water in the second washing drum to be drained into the first washing drum, and recycling the water.

Specifically, step 1: when the first washing drum executes the water intake process, comparing the time $T_{22}$ that the second washing drum waits for execution of the water drainage process with the time $T_{21}$ that the first washing drum waits for execution of the next water intake process. If $T_{22} \geq T_{21}$, enabling pure water to directly enter the first washing drum, and if $T_{22} < T_{21}$, enabling the first washing drum to wait until the second washing drum performs water drainage, and performing step 2.

step 2: judging whether the water in the second washing drum can be reused or not, if yes, enabling the water in the second washing drum to be drained into the first washing drum, recycling the water, if not, enabling the pure water to directly enter the first washing drum. A process of judging whether to wait or not is additionally set, so that the probability that the water in the second washing drum is reused is increased to a great extent, and more water can be reused.

In the step 1, if the second washing drum performs water drainage when the first washing drum executes the water intake process, the time $T_{22}$ that the second washing drum waits for execution of the water drainage process is 0, and the second washing drum does not wait, and the step 2 is directly performed. Whether the second washing drum executes the water drainage process or not at the moment can also be judged firstly before the time $T_{22}$ that the second washing drum waits for execution of the water drainage process is compared with the time $T_{21}$ that the first washing drum waits for execution of the next water intake process. And when the second washing drum does not execute the water drainage process, the time $T_{22}$ that the second washing drum waits for execution of the water drainage process is compared with the time $T_{21}$ that the first washing drum waits for execution of the next water intake process.

In the step 1, allowable waiting time $T_2$ is set, $T_2 < T_{21}$, if $T_{22} < T_2$, the first washing drum waits until the second washing drum performs water drainage, and the step 2 is performed; and if $T_{22} \geq T_2$, the pure water directly enters the first washing drum. In the step, the phenomenon that the first washing drum waits for overlong time can be avoided, the water is reasonably reused on the premise that the washing time of the first washing drum is guaranteed. The phenomenon that the overlong time of the first washing drum is wasted because only reuse of water is taken into account can be avoided, the water in the second washing drum is not reused by the first washing drum if the washing machine judges that the waiting time is overlong and exceeds the set allowable waiting time. The judgement enables the reuse of water to become more reasonable, and the relationship between the waiting time and the reuse of water is coordinated to the maximum extent.

In the step 2, a turbidity value or a foam concentration value of the water in the second washing drum is detected. If the turbidity value or the foam concentration value is smaller than a set value, the water in the second washing drum can be reused, or else, the water in the second washing drum cannot be reused. The water can be reused only when the turbidity value or the foam concentration value of the water is within a set range.

In the step 1, whether the executed water intake process is used for the last-time rinsing water intake or not is judged when the first washing drum executes the water intake process. If yes, the pure water is enabled to directly enter the first washing drum, or else, the time $T_{22}$ that the second washing drum waits for execution of the water drainage process is further compared with the time $T_{21}$ that the first washing drum waits for execution of the next water intake process. Water entering the washing drum for last-time rinsing water intake is guaranteed to be pure water, so that the effect achieved after clothes washing are finished is guaranteed.

In the step 2, whether the first washing drum executes a washing water intake process or not is judged before the water in the second washing drum is drained into the first washing drum. If yes, the first washing drum performs water intake for flushing detergent box firstly, and then, the water in the second washing drum is drained into the first washing drum after the first washing drum finishes water intake for flushing the detergent box. If not, the water in the second washing drum is directly drained into the first washing drum.

In the step 2, the height of a water level inside the first washing drum is detected when the water in the second washing drum is drained into the first washing drum. And if some water exists in the second washing drum when the water level inside the first washing drum reaches a set water level value, residual water in the second washing drum is directly drained. And if the water level inside the first washing drum does not reach the set water level value after the water in the second washing drum is completely drained into the first washing drum, the pure water is enabled to enter the first washing drum.

Whether the first washing drum executes a dewatering process or not at the moment when the water in the second washing drum is directly drained. If yes, the second washing drum performs water drainage after the first washing drum finishes dewatering. If not, time that the first washing drum waits for execution of dewatering is determined as $T_{41}$, time that the first washing drum performs dewatering is determined as $T_{44}$, allowable waiting time $T_4$ is set. If $T_{41}+T_{44}<T_4$, the second washing drum performs water drainage after the first washing drum finishes dewatering, or else, the water in the second washing drum is directly drained.

Whether the water in the first washing drum can be reused or not can be judged by determining a washing state and washing times. In the step 2, the water in the first washing drum cannot be reused, if the second washing drum is in the washing state during water drainage and the first washing drum is in a rinsing state during water intake, or if the second washing drum is in the washing state during water drainage, the first washing drum is in the washing state during water intake, and the washing times of the second washing drum are less than those of the first washing drum, or if the second washing drum is in the rinsing state during water drainage, the first washing drum is in the rinsing state during water intake, the rinsing times of the second washing drum are less than those of the first washing drum.

When the second washing drum executes the water intake process, the time that the first washing drum waits for execution of the water drainage process is compared with the time that the second washing drum waits for execution of the next water intake process, and therefore, whether the second washing drum waits until the first washing drum performs water drainage or not is judged.

A water outlet of the second washing drum communicates with a water inlet of the first washing drum, so that the water in the second washing drum can be drained into the first washing drum to be reused. The water outlet of the second washing drum is provided with a water retaining valve, so that the water in the second washing drum can enter the first washing drum through the water retaining valve. The first washing drum is provided with a water inlet valve, so that external pure water can enter the first washing drum through the water inlet valve, and the control method is as follows:

1), enabling the first washing drum to execute the water intake process;

2), judging whether the water in the second washing drum can be reused or not, if yes, performing step 3), if not, performing step 6);

3), determining the time that the first washing drum waits for execution of the next water intake process as $T_{21}$, determining the time that the second washing drum waits for execution of the water drainage process as $T_{22}$, if $T_{22}<T_{21}$, performing step 4), and if $T_{22}\geq T_{21}$, performing step 6);

4), enabling the first washing drum to wait until the second washing drum performs water drainage, and performing step 5);

5), enabling the water in the second washing drum to be drained into the first washing drum;

6), enabling the pure water to directly enter the first washing drum, and enabling the water in the second washing drum to be directly drained.

The control method can also be additionally provided with a process of judging whether the second washing drum performs water drainage or not before comparing the time $T_{22}$ that the second washing drum waits for execution of the water drainage process with the time $T_{21}$ that the first washing drum waits for execution of the next water intake process, and the control method is as follows:

1), enabling the first washing drum to execute the water intake process;

2), judging whether the water in the second washing drum can be reused or not, if yes, performing step 3), if not, performing step 7);

3), judging whether the second washing drum executes the water drainage process or not, if not, performing step 4), and if yes, performing step 6);

4), determining the time that the first washing drum waits for execution of the next water intake process as $T_{21}$, determining the time that the second washing drum waits for execution of the water drainage process as $T_{22}$, if $T_{22}<T_{21}$, performing step 5), and if $T_{22}\geq T_{21}$, performing step 7);

5), enabling the first washing drum to wait until the second washing drum performs water drainage, and performing step 6);

6), enabling the water in the second washing drum to be drained into the first washing drum;

7), enabling the pure water to directly enter the first washing drum, and enabling the water in the second washing drum to be directly drained.

The control method can also comprise a process of judging whether the first washing drum has enough time to wait until the second washing drum performs water drainage or not, and the control method is as follows:

1), enabling the first washing drum to execute the water intake process;

2), judging whether the water in the second washing drum can be reused or not, if yes, performing step 3), if not, performing step 8);

3), judging whether the second washing drum executes the water drainage process or not, if not, performing step 4), and if yes, performing step 7);

4), determining the time that the first washing drum waits for execution of the next water intake process as $T_{21}$, determining the time that the second washing drum waits for execution of the water drainage process as $T_{22}$, if $T_{22}<T_{21}$, performing step 5), and if $T_{22}\geq T_{21}$, performing step 8);

5), setting allowable waiting time T2, if $T_{22}<T_2$, performing step 6), and if $T_{22}\geq T_2$, performing step 8);

6), enabling the first washing drum to wait until the second washing drum performs water drainage, and performing step 7);

7), enabling the water in the second washing drum to be drained into the first washing drum;

8), enabling the pure water to directly enter the first washing drum, and enabling the water in the second washing drum to be directly drained.

If the water in the second washing drum is very dirty and the water cannot be reused, or the first washing drum performs the last-time rinsing water intake and the water cannot be reused, the control method is as follows:

1), enabling the first washing drum to execute the water intake process;

2), judging whether the first washing drum only needs to perform the last-time rinsing water intake, if not, performing step 3), and if yes, performing step 9).

3), judging whether the second washing drum executes the water drainage process or not, if not, performing step 4), and if yes, performing step 7);

4), determining the time that the first washing drum waits for execution of the next water intake process as $T_{21}$, determining the time that the second washing drum waits for execution of the water drainage process as $T_{22}$, if $T_{22}<T_{21}$, performing step 5), and if $T_{22}\geq T_{21}$, performing step 9);

5), setting allowable waiting time T2, if $T_{22}<T_2$, performing step 6), and if $T_{22}\geq T_2$, performing step 9);

6), enabling the first washing drum to wait until the second washing drum performs water drainage, and performing step 7);

7), detecting the turbidity value or the foam concentration value of the water in the second washing drum, and judging whether the turbidity value or the foam concentration value is smaller than a set value, if yes, performing step 8), and if not, performing step 9);

8), enabling the water in the second washing drum to be drained into the first washing drum; and 9), enabling the pure water to directly enter the first washing drum, and enabling the water in the second washing drum to be directly drained.

If the first washing drum performs washing water intake when the water in the second washing drum is drained into the first washing drum, detergent box flushing and water level detection are still needed, and the control method is as follows:

1), enabling the first washing drum to execute the water intake process;

2), judging whether the first washing drum only needs to perform the last-time rinsing water intake or not, if not, performing step 3), and if yes, performing step 12);

3), judging whether the second washing drum executes the water drainage process or not, if not, performing step 4), and if yes, performing step 7);

4), determining the time that the first washing drum waits for execution of the next water intake process as $T_{21}$, determining the time that the second washing drum waits for execution of the water drainage process as $T_{22}$, if $T_{22}<T_{21}$, performing step 5), and if $T_{22}\geq T_{21}$, performing step 12);

5), setting allowable waiting time $T_2$, if $T_{22}<T_2$, performing step 6), and if $T_{22}\geq T_2$, performing step 12);

6), enabling the first washing drum to wait until the second washing drum performs water drainage, and performing step 7);

7), detecting the turbidity value or the foam concentration value of the water in the second washing drum, and judging whether the turbidity value or the foam concentration value is smaller than a set value, if yes, performing step 8), and if not, performing step 12);

8), judging whether the first washing drum executes the washing water intake process or not, if yes, performing step 9), and if not, performing step 10);

9), enabling the first washing drum to firstly perform water intake for flushing detergent box, and after the first washing drum finishes water intake for flushing the detergent box, performing step 10);

10), enabling the water in the second washing drum to be drained into the first washing drum; and 11), detecting the height of the water level inside the first washing drum, if some water still exists in the second washing drum when the water level inside the first washing drum reaches the set water level value, enabling the residual water to be directly drained; and if the water level inside the first washing drum does not reach the set water level value after the water in the second washing drum is completely drained into the first washing drum, enabling water to enter the first washing drum through an external water inlet;

12), enabling the pure water to directly enter the first washing drum, and enabling the water in the second washing drum to be directly drained.

In the embodiment, the first washing drum and the second washing drum are numbered only aiming at convenient illustration, and numbers do not illustrate an ordinal relation. The water in the first washing drum can also be reused, a water inlet of the second washing drum communicates with a water outlet of the first washing drum, so that the water in the first washing drum can be drained into the second washing drum to be reused. The water outlet of the first washing drum is provided with a water retaining valve, so that the water in the first washing drum can enter the second washing drum through the water retaining valve; the second washing drum is provided with a water inlet valve, so that the external pure water can enter the second washing drum through the water inlet valve. When one of the washing drums performs water intake, whether the water in the other washing drum is drained into the washing drum to be reused or not is judged, and the other washing drum takes no account of reuse of the water in the washing drum when performing water intake, so that dead cycle caused by a phenomenon that the two drums both wait is avoided.

The specific control method is the same as the above and is only different from the above in that the serial number of the first washing drum and the second washing drum are exchanged, and the specific control method is not repeated again herein.

Embodiment 4

Figure 4:
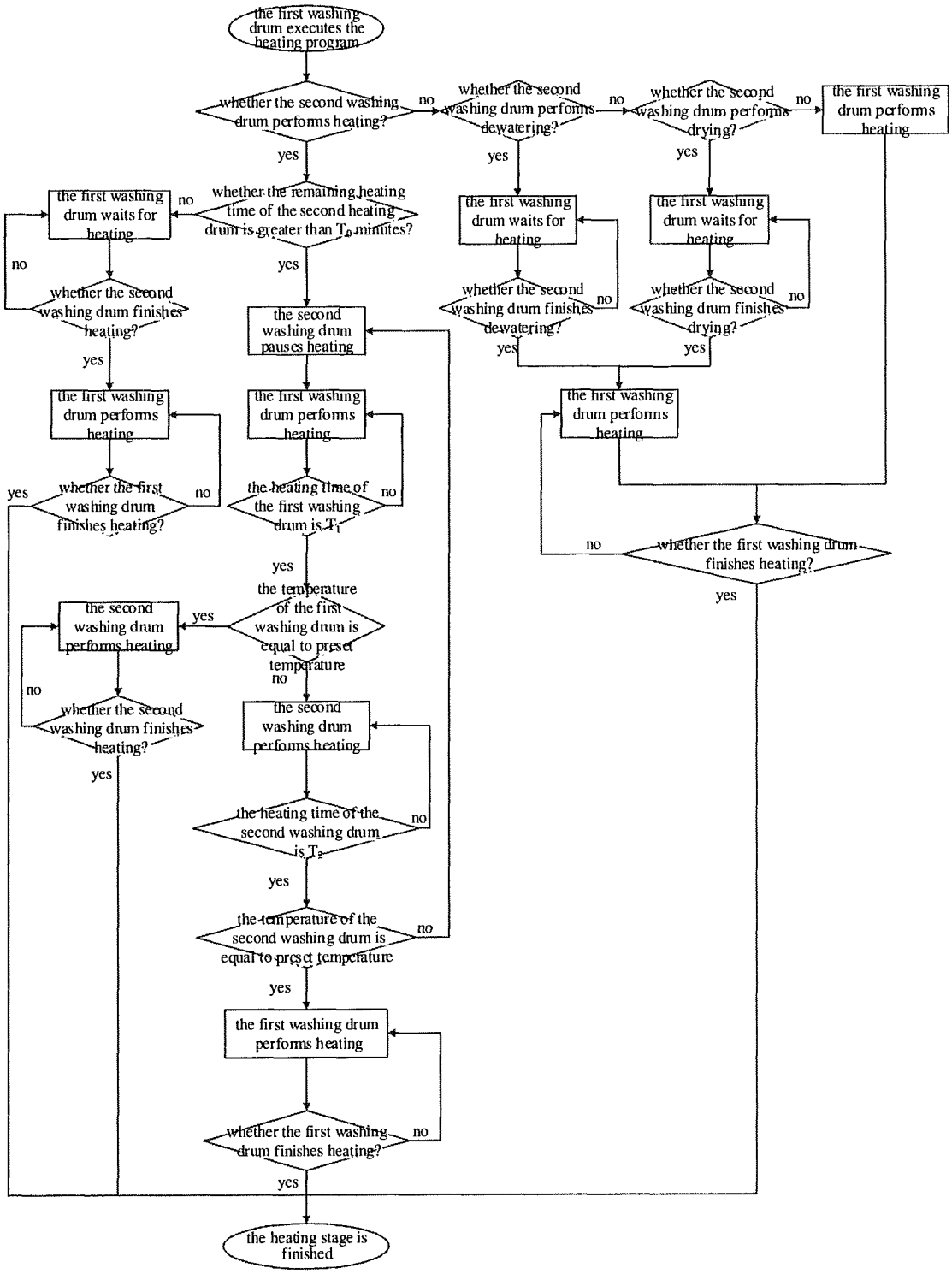
FIG. 4 is a flow chart of a control method for high-power process control of the present disclosure.

As shown in FIG. 4, the high-power process control in the embodiment comprises a heating process control, a dewatering process control and a drying process control, controls the second washing drum not to execute any one of the heating process, the dewatering process and the drying process at the same time before the first washing drum executes the heating process, and controls the second washing drum not to execute any one of the dewatering process, the drying process and the heating process at the same time before the first washing drum executes the dewatering process, and controls the second washing drum not to execute any one of the drying process, the heating process and the dewatering process at the same time before the first washing drum executes the drying process, wherein the heating process control comprises the following steps:

step S21: enabling the first washing drum to perform heating;

step S22: judging whether the second washing drum performs heating or not;

step S23: if yes, judging whether the remaining heating time of the second washing drum is greater than $T_0$ or not;

step S24: if yes, executes an alternate heating program that the first washing drum and the second washing drum perform heating alternately for a period of time, if not, executes an ordered heating program that the second washing drum performs heating firstly, and then the first washing drum performs heating; and wherein $T_0$ is a time value set by a system and used for judging whether the second washing drum is about to finish heating or not.

In the embodiment, firstly judging whether the second washing drum is in a heating state or not before the first washing drum performs heating. If the second washing drum is performing heating, the first washing drum waits for performing heating or the first washing drum and the second drum perform heating alternately according to the principle of "high power operation at different times" (i.e., the two washing drums perform high-power operation at different times, so that the instantaneous power of the double-drum washing machine can be reduced, and the stability of the double-drum washing machine can be guaranteed).

When the ordered heating program that the second washing drum performs heating firstly and then the first washing drum performs heating is selected and when the alternate heating program that the first washing drum and the second washing drum perform heating alternately is selected are determined mainly by judging whether the heating time of the second drum is about to finish or not. If the second drum is about to finish heating, the ordered heating program that the first drum performs heating after the second drum finishes heating is adopted, and if the heating time of the second drum is still very long, the second drum pauses heating, and the alternate heating program that the first drum and the second drum perform heating alternately for a period of time is adopted.

The selection and judgement manners adopted in the embodiment have the advantages that firstly, the process that the first drum waits if the second drum is about to finish heating more, which is selected, conforms to actual conditions, so that frequent controlling and switching of heated objects is avoided, and the heating efficiency is improved. Secondly, the process that the two drums perform heating alternately if the second drum still needs a certain heating time is selected, so that the heating of the first drum can be accelerated, and the phenomenon that the washing waiting time of the first drum is prolonged because the waiting time of the first drum is overlong is avoided. Therefore, the washing processes of the two drums can be executed at the same time, and the use experience of a user is improved. And finally, the manner that only one drum executes the heating process no matter which heating process is selected conforms to the basic principle of "high power operation at different times".

The key point in the embodiment lies in how to judge whether the second drum is about to finish heating or not. Specifically, whether the second drum is about to finish heating or not can be judged by judging whether the heating time of the second drum is about to reach a preset value or whether the heating temperature of the second drum is about to reach a preset value or not. As a preferred implementation of the control method, conventional heating process setting is generally realized by setting the heating time, and therefore, whether the heating time of the second drum is about to be used out or not is judged. That is, whether the remaining heating time of the second washing drum is greater than $T_0$ or not is judged, and $T_0$ is a time value set by a system and used for judging whether the second washing drum is about to finish heating or not.

It is apparent that the specific set value of $T_0$ should be related to the total heating time of the second drum, i.e., if the total heating time of the second washing drum is $T_{m2}$, and $0<T_0\leq\frac{1}{3}T_{m2}$. Preferably, the set value of $T_0$ should be as small as possible.

The general experience value of $T_0$ can be determined according to the total washing period and the heating time of the washing machine, and preferably, $0<T_0\leq 5$ min.

In the alternate heating program in the step S24 in the embodiment, the first washing drum and the second washing drum sequentially perform heating alternately for certain time intervals. Whether the first washing drum and the second washing drum finish heating or not is judged after the heating at every time interval is finished. If the first washing drum/the second washing drum finishes heating, the second washing drum/the first washing drum performs heating all the time until the heating is finished, if not, the second washing drum and the first washing drum further perform heating alternately.

In the alternate heating program in the embodiment, judgement is performed after each heating time interval is finished, timely adjustment is performed according to the judgement result, and if one of the drums finishes heating, the other drum can also perform heating more rapidly, so that the heating efficiency is improved.

Specifically, the alternate heating program in the step S24 of the control method comprises the following steps:

step S241: enabling the second washing drum to pause heating;

step S242: enabling the first washing drum to start heating;

step S243: judging whether the heating time of the first washing drum is equal to $T_1$ or not;

step S244: if yes, performing the next step, if not, returning to step S242;

step S245: judging whether the temperature of the first washing drum is equal to the preset temperature;

step S246: if yes, enabling the second washing drum to perform heating all the time to reach the pre-set temperature, and then finishing the heating stage, if not, performing the next step;

step S247: enabling the second washing drum to start heating;

step S248: judging whether the heating time of the second washing drum is equal to $T_2$ or not;

step S249: if yes, performing the next step, if not, returning to step S247;

step S2410: judging whether the temperature of the second washing drum is equal to the preset temperature;

step S2411: if yes, enabling the first washing drum to perform heating all the time to reach the preset temperature, and then, finishing the heating stage, if not, returning to the step S241.

The first drum and the second drum in the embodiment perform heating alternately, the heating time of the first drum each time is $T_1$, the heating time of the second drum each time is $T_2$, the settings of $T_1$ and $T_2$ are also related to the total heating time $T_{1m}$ of the first drum and the total heating time $T_{m2}$ of the second drum. Which $0<T_1\leq\frac{1}{2}T_{1m}$, $0<T_2\leq\frac{1}{2}T_{m2}$, preferably, $0<T_1\leq\frac{1}{4}T_{1m}$, $0<T_2\leq\frac{1}{4}T_{m2}$.

Besides, the set values of $T_1$ and $T_2$ can be equal or unequal, if the total heating time $T_{1m}$ of the first drum differs greatly from the total heating time $T_{m2}$ of the second drum, preferably, and the set values of $T_1$ and $T_2$ are unequal. Thus, it is more beneficial for the first drum and the second drum to perform heating alternately so as to ensure that the first drum and the second drum finish heating at the same time.

As a preferred implementation in the embodiment, generally, no great difference exists in the heating time of washing machines, so that $T_1$ and $T_2$ are respective minimum time intervals when the first washing drum and the second washing drum perform heating every time, and preferably, $T_1$ is equal to $T_2$.

Specifically, the ordered heating program in the step S24 of the control method comprises the following steps:

step S2412: enabling the first washing drum to wait for execution of heating;

step S2413: judging whether the second washing drum finishes heating or not;

step S2414: if yes, performing the next step, if not, returning to step S2412;

step S2415: enabling the first washing drum to start heating;

step S2416: judging whether the first washing drum finishes heating or not;

step S2417: if yes, finishing the heating stage, if not, returning to step S2415.

Further, the method for judging whether the second washing drum and the first washing drum finish heating or not in the step S2413 and the step S2416 is realized by judging whether the heating temperatures of the second washing drum and the first washing drum reach the preset heating temperature values or not. And if the heating temperatures of the second washing drum and the first washing drum reach the preset heating temperature values, the second washing drum and the first washing drum finish heating, if not, the heating is not finished.

In the embodiment, the heating temperatures of both the ordered heating program and the alternate heating program are judged in the heating process to judge whether the heating temperature reaches the preset heating temperature or not. So that a first temperature sensor and a second temperature sensor which are used for monitoring temperatures are arranged in the first drum and the second drum of the double-drum washing machine provided by the present disclosure.

Before the first drum in the embodiment performs heating, not only is whether the second drum performs heating or not judged, but also whether the second drum executes other high-power processes or not needs to be judged if the second drum does not perform heating, so that the principle of "high power operation at different times" is met.

Specifically, if the judgement result in the step S23 is no, the following steps are performed:

step S231: judging whether the second washing drum performs dewatering or not;

step S232: if yes, performing the next step;

step S233: enabling the first washing drum to wait for execution of heating;

step S234: judging whether the second washing drum finishes dewatering or not; and step S235: if yes, performing the next step, if not, returning to step S233;

step S236: enabling the first washing drum to start heating;

step S237: judging whether the first washing drum finishes heating or not; and step S238: if yes, finishing the heating stage, if not, returning to step S236.

In the heating process control in the embodiment, if the second drum is judged not to perform heating when the first drum performs heating, whether the second drum performs dewatering or not is further judged. If the second drum performs dewatering, and the first drum waits for executing the heating process until the second drum finishes dewatering, and then executes the heating process. So that the phenomenon that the heating effect or the dewatering effect of the washing machine is affected by over high power of the washing machine because the second drum performs dewatering while the first drum performs heating is avoided.

Further, if the judgement result in the step S232 is no, the following steps are performed:

step S2321: judging whether the second washing drum performs drying or not;

step S2322: if yes, performing the next step, if not, enabling the first washing drum to perform heating until the heating process is finished;

step S2323: enabling the first washing drum to wait for execution of heating;

step S2324: judging whether the second washing drum finishes drying or not;

step S2325: if yes, performing the next step, if not, returning to step S2323;

step S2326: enabling the first washing drum to start heating;

step S2327: judging whether the first washing drum finishes heating or not; and step S2328: if yes, finishing the heating process, or else, returning to step S2326.

The influence of the drying process on the power is also taken into account in the heating process control in the embodiment. When the first drum performs heating, the second drum is determined not to perform high-power processes such as heating and dewatering. Further, whether the second drum executes the drying process or not is judged. If the second drum performs drying, the first drum waits heating and starts to perform heating after the second drum finishes drying. So the phenomenon that two high-power heating and drying processes are executed at the same time is further avoided.

In conclusion, the heating process control in the embodiment takes both cases that whether the second drum performs heating or not and whether the second drum performs dewatering and drying or not into account before the first drum performs heating, and therefore, various high-power factors are comprehensively considered, the control method is more comprehensive, and the stability and the service life of the double-drum washing drum are guaranteed.

Embodiment 5

Figure 5:
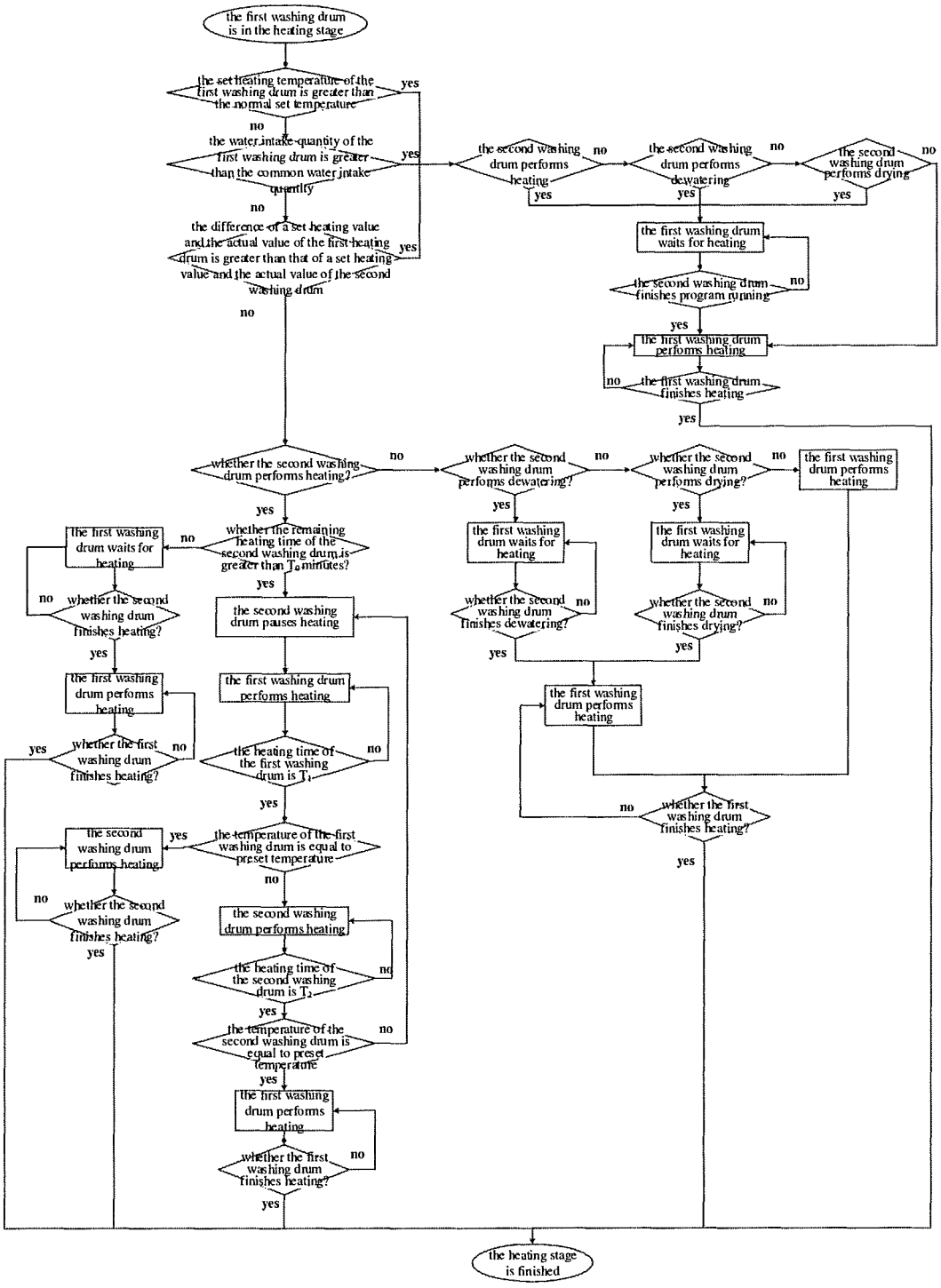
FIG. 5 is a flow chart of a control method in another embodiment for high-power process control of the present disclosure.

As shown in FIG. 5, the high-power process control in the embodiment comprises heating process control, the washing machine at least comprises the first washing drum and the second washing drum, whether the heating time required by the first washing drum is overlong or not is judged before the first washing drum performs heating. If yes, the second washing drum preferentially executes the heating, or dewatering, or drying processes, if not, the following step is performed:

step S101: judging whether the second washing drum performs heating or not;

step S102: if yes, judging whether the remaining heating time of the second washing drum is greater than $T_0$ or not;

step S103: if the judgement result is yes, starting the program that the first washing drum and the second washing drum perform heating alternately, and if the judgement result is not, starting the ordered heating program that the second washing drum performs heating firstly, and then the first washing drum performs heating, wherein $T_0$ is a time value set in the method for judging whether the heating of the second washing drum is about to finish or not.

In the heating process control in the embodiment, whether the heating time required by the first washing drum is overlong or not is judged before the first washing drum performs heating: if the heating time required by the first washing drum is overlong, because the heating time of the first washing drum is relatively long, the second washing drum is used for preferentially executing the high-power process such as the heating, or dewatering, or drying process; then, the first washing drum starts to perform heating, so that the phenomenon that the waiting time of the second washing drum is overlong because the heating time of the first washing drum is overlong is avoided. And if the heating time required by the first washing drum is not overlong, it indicates that the normal heating time of the first washing drum or the heating time required by the washing drum is relatively short, so that the program that the first washing drum preferentially performs heating or the first washing drum and the second washing drum perform heating alternately is selected, and the heating waiting time of the first washing drum is shortened.

Compared with the maximum heating time of the washing drums, whether the heating time required by the first washing drum in the embodiment is overlong or not is judged, i.e., it can be believed that the heating time required by the first washing drum at the moment exceeds a common heating time range and is overlong when the heating time required by the first washing drum approaches to or reaches the maximum heating time. And it can be believed that the heating time required by the first washing drum is within the common heating time range and is not overlong when the heating time required by the first washing drum does not approach to the maximum heating time, i.e., a certain time interval exists between the heating time required by the first washing drum and the maximum heating time.

In addition, if the heating time required by the first washing drum is not overlong, the heating process control in the embodiment realizes heating control on the double-drum washing machine in an ordered heating and alternate heating combined manner, and the corresponding heating manner is selected by judging whether the heating process of the drum executing the heating process is about to finish or not. Therefore, the corresponding heating process is adopted according to the actual use condition in the control method provided by the present disclosure, so that the heating efficiency is higher, and the power control is more precise.

In the embodiment, the judgement on whether the heating time required by the first washing drum is overlong or not comprises the following judgement conditions:

a) whether a set heating temperature of the first washing drum is higher than a normal set temperature or not;

b) whether a water intake quantity of the first washing drum is greater than common water intake quantity or not;

c) whether a difference of the set heating temperature value and a real-time measurement value of the first washing drum is greater than a difference of a set heating temperature value and a real-time measurement value of the second washing drum or not;

if all the judgement results in a), b) and c) are not, determining that the heating time required by the first washing drum is not overlong; and if any one of the judgement results in a), b) and c) is yes, determining that the heating time required by the first washing drum is overlong.

Specifically, the normal set temperature in the judgement condition a) in the embodiment is smaller than the maximum heating temperature value set for the first washing drum in the method. The clothes washing cleanliness can be improved when the washing water is heated to achieve a certain temperature, but if the heating temperature is over high, on one hand, the fabric of clothes can be damaged, on the other hand, the use experience of a user can also be greatly reduced by overlong heating time, high power consumption and other problems brought by high heating temperature. And therefore, the normal set temperature accounts for 60%-90% of the maximum heating temperature set in the method; preferably, the normal set temperature accounts for 70%-80% of the maximum heating temperature set in the method; and preferably, X=60° C.

Similarly, the common water intake quantity in the judgement condition b) in the embodiment accounts for 80%-95% of the maximum water intake quantity set in the method, and preferably, the common water intake quantity accounts for 95%-95% of the maximum water intake quantity set in the method.

The water intake quantity of the washing machine is indirectly presented by setting of water intake water levels in actual use. Therefore, the first washing drum for the control method disclosed by the present disclosure is provided with a plurality of water intake water levels which correspond to different water intake quantities, the common water intake quantity corresponds to a common water intake water level which is a water intake water level which approaches to the maximum water intake water level to the greatest extent.

The judgement according to the judgement condition b) is realized in the following manners:

judging whether the water intake water level set for the first washing drum is higher than the water intake water level corresponding to the common water intake quantity or not.

If yes, determining that the water intake quantity set for the first washing drum is greater than the common water intake quantity, if not, determining that the water intake quantity set for the first washing drum is smaller than the common water intake quantity.

Specifically, five water intake water levels including a low water intake water level, a medium-low water intake water level, a medium water intake water level, a medium-high water intake water level and a high water intake water level are set. But the common water intake water level is the medium water intake water level or the medium-high water intake water level, and the judgement according to the judgement condition b) is realized in the following manner:

judging whether the water intake water level set for the first washing drum is higher than the medium water intake water level or the medium-high water intake water level or not.

If yes, determining that the water intake quantity set for the first washing drum is greater than the common water intake quantity, if not, determining that the water intake quantity set for the first washing drum is smaller than the common water intake quantity.

According to the control method disclosed by the present disclosure, the heating time is determined by the setting of washing processes, i.e., the first washing drum corresponds to different washing processes, while the heating time of each washing process is determined to a great extent by the water intake quantity of washing water, the set value of the heating temperature and the real-time temperature difference value of washing water required to be heated in each of the washing processes. Therefore, each washing process corresponds to one of different heating times. Therefore, the maximum heating time is the heating time required when the water intake quantity is maximum, the set value of the heating temperature is maximum and the real-time temperature difference value of the washing water required to be heated is maximum in each washing process.

As shown in FIG. 5, the heating process control of the high-power process control in the embodiment comprises the following steps:

step S1: enabling the first washing drum to execute the heating process;

step S2: judging whether the heating temperature set for the first washing drum is higher than the normal set temperature or not;

step S3, if not, performing step S4, if yes, performing step S201;

step S4: judging whether the water intake quantity of the first washing drum is greater than the common water intake quantity or not;

step S5: if not, performing step S6; if yes, performing step S201;

step S6: judging whether a difference of a set heating temperature value and a real-time measurement value of the first washing drum is greater than that of a set heating temperature value and a real-time measurement value of the second washing drum or not;

step S7: if not, performing step S101; if yes, performing step S201;

step S101: judging whether the second washing drum performs heating or not;

step S102: if yes, judging whether the remaining heating time of the second washing drum is greater than $T_0$ or not;

step S103: if the judgement result is yes, starting the program that the first washing drum and the second washing drum perform heating alternately, and if the judgement result is not, starting the ordered heating program that the second washing drum performs heating firstly, and then the first washing drum performs heating;

step S201: judging whether the second washing drum performs heating or not;

step S202: if yes, enabling the first washing drum waits until the second washing drum finishes the heating process. then execute the heating process, if not, performing the next step;

step S203: judging whether the second washing drum performs dewatering or not;

step S204: if yes, enabling the first washing drum waits until the second washing drum finishes the dewatering process, then execute the heating process, if not, performing the next step;

step S205: judging whether the second washing drum performs drying or not;

step S206: if yes, enabling the first washing drum waits until the second washing drum finishes the drying process, then execute the heating process, if not, enabling the first washing drum to execute the heating process.

The program that the first washing drum and the second washing drum perform heating alternately and the ordered heating program that the second washing drum performs heating firstly, and then the first washing drum performs heating, in the step S103 in the embodiment are same as those in the embodiment 4, no more detailed description herein.

Embodiment 6

Figure 6:
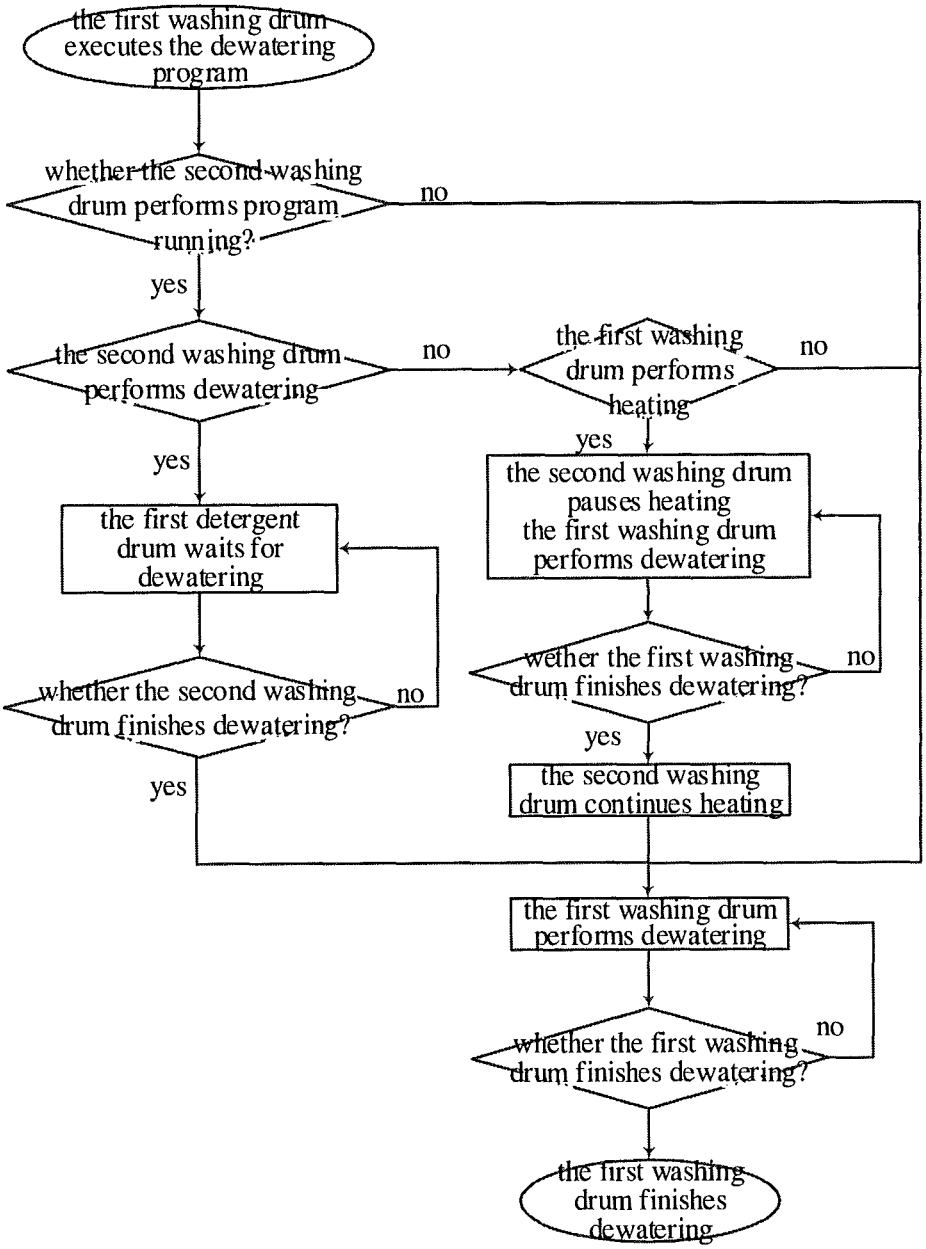
FIG. 6 is a flow chart of a control method for a dewatering process of the prevent disclosure.

As shown in FIG. 6, the dewatering process control of the high-power process control for the control method disclosed by the present disclosure is shown in the embodiment, is mainly used for controlling the dewatering process and specifically comprises the following steps:

1) before the first washing drum performs dewatering;

2) judging whether the second washing drum executes a process or not;

3) if yes, performing step 4), if not, enabling the first washing drum to perform dewatering;

4) judging whether the second washing drum performs dewatering or not;

5) if yes, performing step 6); if not, performing step 7);

6) enabling the first washing drum to perform dewatering after the second washing drum finishes dewatering;

7) judging whether the second washing drum performs heating or not;

8) if yes, performing step 9), if not, enabling the first washing drum to perform dewatering;

9) enabling the second washing drum to pause heating, and enabling the first washing drum to perform dewatering;

The high-power process control in the embodiment is used for realizing control on the dewatering process, the time spent by execution of the dewatering process of the washing machine is shorter than the time spent by execution of other processes. So the embodiment adopts the principle that the dewatering process is preferentially executed: if the second washing drum is executing the dewatering process when the first washing drum performs the dewatering process, the first washing drum performs dewatering after the second washing drum finishes dewatering. And if the second washing drum is executing the high-power process such as the heating or drying process, the high-power process such as the heating or drying process being executed by the second washing drum is paused, and after the first washing drum preferentially executes the dewatering process, the second washing drum further executes the high-power process such as the heating or drying process.

Therefore, the dewatering control process in the embodiment has the following beneficial effects:

1) the phenomena that when two or more drums execute the dewatering process at the same time, relatively great resonance quantity is caused, relatively high noise is generated, the use experience of the user is affected, and besides, the washing machine can also be damaged to a certain extent because of the relatively great resonance quantity, is avoided; and 2) the phenomenon that multiple drums execute the high-power process at the same time can be avoided, loss caused by over high instantaneous power of the washing machine is avoided, and the stability and the service life of the washing machine are guaranteed.

Embodiment 7

Figure 7:
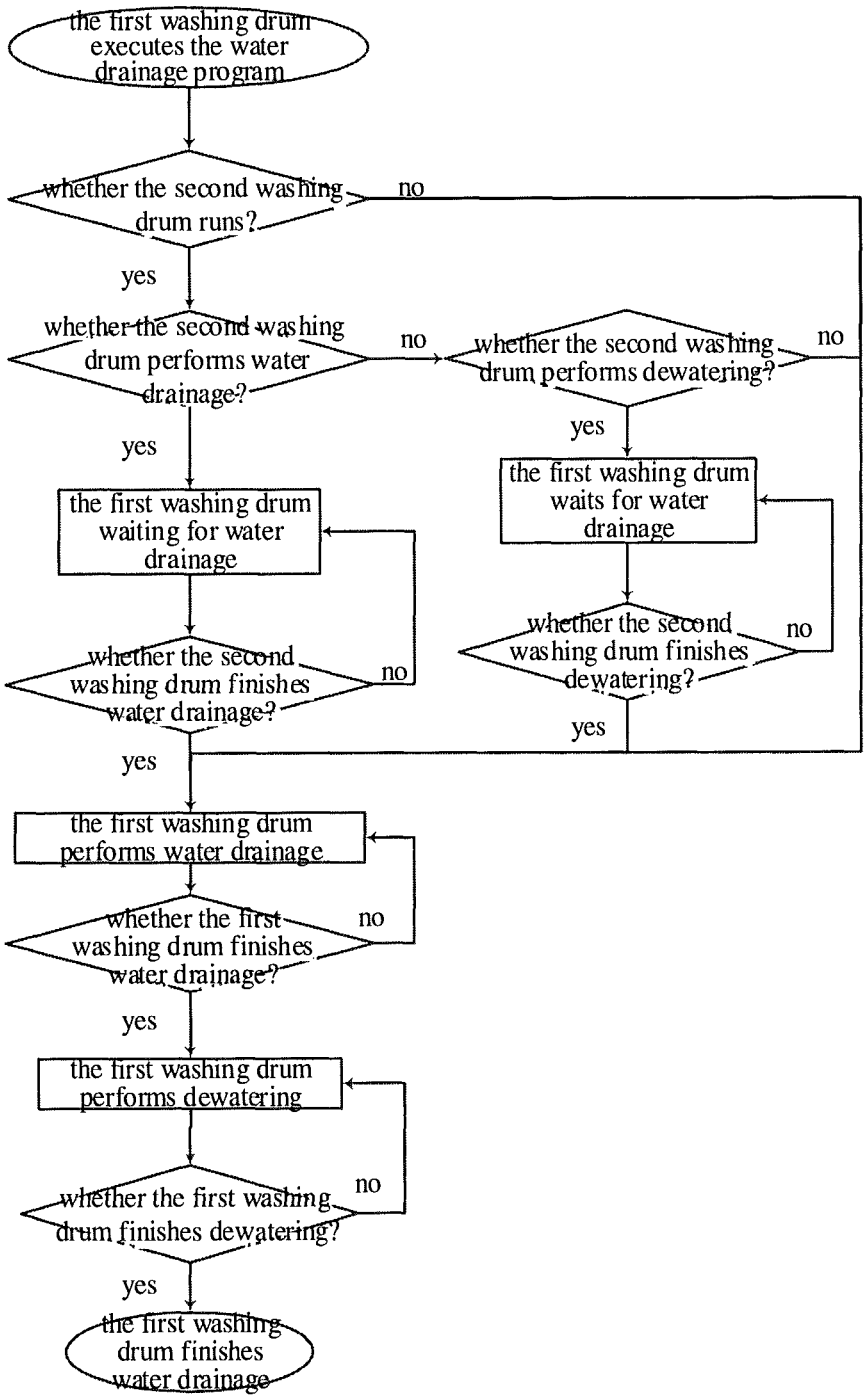
FIG. 7 is a flow chart of a control method for a water drainage process of the present disclosure.

As shown in FIG. 7, the water drainage control in the water intake and drainage control used when the drained water of the first washing drum is not reused is shown in the embodiment and specifically comprises the following steps:

1) before the first washing drum performs water drainage;

2) judging whether the second washing drum is executing a process or not;

3) if yes, performing step 4), if not, enabling the first washing drum to perform water drainage;

4) judging whether the second washing drum is performing water drainage or not; and 5) if yes, enabling the first washing drum to perform water drainage after the second washing drum finishes water drainage, if not, enabling the first washing drum to perform water drainage.

The water drainage control process in the embodiment realizes control on the water drainage process and adopts an ordered control logic, so that the effect of simple realization and easy control is realized. Only one drum performs water drainage at any moment, so that the water drainage reliability is guaranteed, and the problem that water in the two drums is polluted mutually cannot be caused. Besides, vibration caused by dewatering is detected, and the overall structural gravity centre is lowered through the weights of washing clothes and washing water in the lower drum, so that the vibration and noise reduction effect is realized.

Embodiment 8

The embodiment provides a control method of a double-drum washing machine, wherein the control method specifically comprises the following steps:

1) starting the washing machine;

2) selecting a washing process;

3) starting the washing process;

4) performing water intake control before a first washing drum executes a water intake process;

5) enabling the first washing drum to start to execute the water intake process, and enabling the first washing drum to start to perform water intake;

6) judging whether a water intake water level inside the first washing drum reaches a set value or not, if yes, enabling the first washing drum to stop the water intake process, if not, returning to the step 5);

7) performing heating process control of high-power process control before the first washing drum executes a heating process;

8) enabling the first washing drum to start to execute the heating process, and enabling the first washing drum to heat washing water;

9) judging whether the heating temperature of the first washing drum reaches a set value or not, if yes, enabling the first washing drum to stop the heating process, if not, returning to the step 8);

10) enabling the first washing drum to start to execute the washing process;

11) judging whether the washing time of the first washing drum reaches a set value or not, if yes, enabling the first washing drum to stop the washing process, if not, returning to the step 10);

12) enabling the first washing drum to start a rinsing process;

13) performing water intake control before the first washing drum executes the water intake process;

14) enabling the first washing drum to start to execute the water intake process, and enabling the first washing drum to start to perform water intake;

15) judging whether a water intake water level inside the first washing drum reaches a set value or not, if yes, enabling the first washing drum to stop the water intake process, if not, returning to the step 14);

16) enabling the first washing drum to start to rinse;

17) judging whether the rinsing time of the first washing drum reaches a set value or not, if yes, enabling the first washing drum to stop rinsing, if not, returning to the step 16);

18) performing dewatering process control of the high-power process control before the first washing drum executes a dewatering process;

19) enabling the first washing drum to start to execute the dewatering process;

20) judging whether the dewatering time of the first washing drum reaches a set value or not, if yes, enabling the first washing drum to stop dewatering, if not, returning to the step 19);

21) performing drying process control of the high-power process control before the first washing drum executes a drying process;

22) enabling the first washing drum to start to execute the drying process;

23) judging whether the first washing drum finishes the drying process or not according to the temperature and the humidity of the first washing drum, if yes, performing the next step, if not, returning to the step 22); and 24) enabling the first washing drum to stop working.

The rinsing process in the embodiment can be executed many times according to the actual use condition, i.e., the steps 16)-19) can be executed repeatedly, and the rinsing process is not limited to be executed only one time. The control processes of relevant processes in the water intake control and the high-power process control in the above steps are the same as those in the embodiment 2 to the embodiment 7, no more detailed description herein.

The embodiment is illustrated by taking the first washing drum as an example, but the technical scheme of the embodiment is not limited, and a second washing drum in the embodiment also adopts the same technical scheme, no more detailed description herein.

The above mentioned should not make any limit in term of form of the present disclosure, but is merely used as preferred embodiments of the present disclosure, and although the above mentioned as the preferred embodiments is disclosed, the preferred embodiments are not intended to limit the present disclosure. Various changes or modifications can be made by the persons skilled in the art according to the prompted technical content without departing from the scope of the technical scheme of the present disclosure to achieve equivalent embodiments with equal changes, and any simple changes, equivalent variations and modifications for the above embodiments according to the technical essence of the present disclosure without departing from the content of the technical scheme of the present disclosure are still intended to be within the scope of the scheme of the present disclosure.

The invention claimed is:

1. A control method of a double-drum washing machine, the washing machine at least comprising a first washing drum and a second washing drum, wherein the control method comprises a water intake and drainage control and a high-power process control, the water intake and drainage control comprises a water intake control and a water drainage control;

judging whether to reuse drained water of the second washing drum or not in the first washing drum before executing a water intake process according to a turbidity value or a foam concentration value of the drained water; and judging whether to enable the drained water from the first washing drum to be drained into the second washing drum and reuse the drained water or not before executing a water drainage process according to the turbidity value or the foam concentration value of the drained water;

and the high-power process control is used for controlling any one of a heating process, a dewatering process and a drying process of the first washing drum and any one of a heating process, a dewatering process and a drying process of the second washing drum not to be executed at the same time.

2. The control method of the double-drum washing machine according to claim 1, wherein the water intake control of the water intake and drainage control comprises:

comparing a time $T_{22}$ that the second washing drum waits for an execution of the water drainage process with a time $T_{21}$ that the first washing drum waits for an execution of a next water intake process before the first washing drum executes the water intake process, if $T_{22} \geq T_{21}$, pure water is directly supplied into the first washing drum, and if $T_{22} \leq T_{21}$, enabling the first washing drum to wait until the second washing drum performs water drainage.

3. The control method of the double-drum washing machine according to claim 2 wherein, it is judged whether water in the second washing drum can be reused or not before comparing the time $T_{22}$ that the second washing drum waits for the execution of the water drainage process with the time $T_{21}$ that the first washing drum waits for the execution of the next water intake process, if not, the pure water is directly supplied into the first washing drum, and if yes, it is compared the time $T_{22}$ that the second washing drum waits for the execution of the water drainage process with the time $T_{21}$ that the first washing drum waits for the execution of the next water intake process;

or it is judged whether water in the second washing drum can be reused or not when the first washing drum waits until the second washing drum performs water drainage, if not, the pure water is directly supplied into the first washing drum, and if yes, enabling the water in the second washing drum to be drained into the first washing drum, and reusing the water.

4. The control method of the double-drum washing machine according to claim 1, wherein the water drainage control of the water intake and drainage control comprises: it is compared a time $T_{12}$ that the second washing drum waits for an execution of the water intake process with a time $T_{11}$ that the first washing drum waits for an execution of a next water drainage process before the first washing drum executes the water drainage process, if $T_{12} < T_{11}$, enabling the first washing drum to wait until the second washing drum performs water intake, and if $T_{12} \geq T_{11}$, enabling water in the first washing drum to be directly drained.

5. The water drainage control method of the double-drum washing machine according to claim 4, wherein it is judged whether the water in the first washing drum can be reused or not before comparing the time $T_{12}$ that the second washing drum waits for the execution of the water intake process with the time $T_{11}$ that the first washing drum waits for the execution of the next water drainage process, if not, enabling the water in the first washing drum to be directly drained, and if yes, it is compared the time $T_{12}$ that the second washing drum waits for the execution of the water intake process with the time $T_{11}$ that the first washing drum waits for the execution of the next water drainage process;

or it is judged whether the water in the first washing drum can be reused or not when the first washing drum waits until the second washing drum performs water intake, if not, enabling the water in the first washing drum to be directly drained, and if yes, enabling the water in the first washing drum to be drained into the second washing drum, and reusing the water.

6. The control method of the double-drum washing machine according to claim 1, wherein the high-power process control comprises: a heating process control, a dewatering process control and a drying process control, and the high-power process control controls the second washing drum not to execute any one of the heating process, the dewatering process and the drying process at the same time when the first washing drum executes the heating process, and controls the second washing drum not to execute any one of the dewatering process, the drying process and the heating process at the same time when the first washing drum executes the dewatering process, and controls the second washing drum not to execute any one of the drying process, the heating process and the dewatering process at the same time when the first washing drum executes the drying process.

7. The control method of the double-drum washing machine according to claim 6, wherein the heating process control of the high-power process control comprises:

step S21: enabling the first washing drum to perform heating;

step S22: judging whether the second washing drum is performing heating or not;

step S23: if yes, judging whether a remaining heating time of the second washing drum is greater than $T_0$ or not;

step S24: if yes, executing an alternate heating program that the first washing drum and the second washing drum perform heating alternately, if not, executing an ordered heating program that the second washing drum performs heating firstly, and then the first washing drum performs heating, wherein $T_0$ is a time value set by a system and used for judging whether the second washing drum is about to finish heating or not.

8. The control method of the double-drum washing machine according to claim 7, wherein if a judgement result in the step S22 is not, performing the following steps:

it is judged whether any one of the dewatering process and the drying process is executed by the second washing drum or not, if yes, enabling the first washing drum to start to perform heating after the second washing drum finishes the dewatering process or the drying process, if not, enabling the first washing drum to directly start to perform heating.

9. The control method of the double-drum washing machine according to claim 7, wherein before performs the step S21 in the heating process control of the high-power process control, performs judgement as follows:

it is judged whether a heating time required by the first washing drum is overlong or not, if yes, enabling the second washing drum to preferentially execute the heating, or dewatering, or drying process, if not, performing the step S21.

10. The control method of the double-drum washing machine according to claim 9, wherein a step of judging whether the heating time required by the first washing drum is overlong or not comprises the following judgement conditions:

a) whether a set heating temperature of the first washing drum is higher than a normal set temperature or not;

b) whether a water intake quantity of the first washing drum is greater than a common water intake quantity or not;

c) whether a difference of the set heating temperature value and a real-time measurement value of the first washing drum is greater than a difference of the set heating temperature value and a real-time measurement value of the second washing drum or not;

if all the judgement results in a), b) and c) are not, determining that the heating time required by the first washing drum is not overlong; and if any one of the judgement results in a), b) and c) is yes, determining that the heating time required by the first washing drum is overlong.

* * * * *